US011617940B2

(12) United States Patent
Betlach

(10) Patent No.: US 11,617,940 B2
(45) Date of Patent: Apr. 4, 2023

(54) PUZZLE BOX LID HOLDER

(71) Applicant: Anthony Betlach, Big Lake, MN (US)

(72) Inventor: Anthony Betlach, Big Lake, MN (US)

( * ) Notice: Subject to any disclaimer, the term of this patent is extended or adjusted under 35 U.S.C. 154(b) by 58 days.

(21) Appl. No.: 17/346,698

(22) Filed: Jun. 14, 2021

(65) Prior Publication Data

US 2022/0249942 A1 Aug. 11, 2022

Related U.S. Application Data

(60) Provisional application No. 63/148,207, filed on Feb. 11, 2021.

(51) Int. Cl.

| | |
|---|---|
| ***A63F 9/00*** | (2006.01) |
| ***A63F 9/10*** | (2006.01) |
| ***A47F 7/00*** | (2006.01) |

(52) U.S. Cl.

CPC ..... *A63F 9/1044* (2013.01); *A47F 7/00* (2013.01)

(58) Field of Classification Search

None

See application file for complete search history.

(56) References Cited

U.S. PATENT DOCUMENTS

| | | | | |
|---|---|---|---|---|
| 5,145,062 | A * | 9/1992 | Crispi | B65D 5/4233 206/457 |
| 5,910,038 | A * | 6/1999 | Zheng | A63H 33/067 446/114 |
| D652,457 | S * | 1/2012 | Robins | D21/491 |
| 10,371,311 | B2 * | 8/2019 | Naylor-Warren | F16M 11/38 |
| D938,278 | S * | 12/2021 | Johnson | D6/682.3 |
| D938,823 | S * | 12/2021 | Johnson | D6/682.3 |
| 2005/0072892 | A1 * | 4/2005 | Fell | A47F 5/10 40/538 |
| 2010/0320349 | A1 * | 12/2010 | Necessary | F16M 11/10 248/346.03 |
| 2020/0333839 | A1 * | 10/2020 | Vidyasagaran | A47B 19/10 |
| 2022/0247851 | A1 * | 8/2022 | Wilinski | H04M 1/06 |
| 2022/0305372 | A1 * | 9/2022 | Stephenson | A47B 23/001 |

* cited by examiner

*Primary Examiner* — Steven M Marsh

(74) *Attorney, Agent, or Firm* — Brennan, Manna & Diamond, LLC

(57) ABSTRACT

The present invention relates to a puzzle box lid holder device designed to hold the puzzle box lid having a puzzle illustration in a position that is always visible to the user. The holder device has a slot within the body which is dimensioned to receive a puzzle box lid wall and hold the puzzle box lid securely in a substantially upright position. The slot is dimensioned to receive a box lid wall up to a depth of approximately 3" and having a thickness of approximately 0.2". The slot is recessed across a front portion of the holder device to accommodate box lids of any size. Users can maintain hands-free operation of the box lid while having the puzzle illustration visually available to the user allowing the user to more easily and enjoyably complete the puzzle.

7 Claims, 3 Drawing Sheets

PUZZLE BOX LID HOLDER

CROSS-REFERENCE TO RELATED APPLICATION

The present application claims priority to, and the benefit of, U.S. Provisional Application No. 63/148,207, which was filed on Feb. 11, 2021 and is incorporated herein by reference in its entirety.

FIELD OF THE INVENTION

The present invention relates generally to the field of holding devices. More specifically, the present invention relates to a puzzle box lid holder that is intended to keep the lid of the puzzle box and the puzzle illustration on the lid visible to the puzzler at all times. The puzzle illustration on the puzzle box lid is used by the puzzler as a reference when constructing the puzzle. The puzzle box lid holder is comprised of a solid material in which a properly-oriented slot is made. In use, the base of the puzzle box lid is inserted into the slot, thereby allowing the illustration on the lid to be held upright and visible to the puzzler at all times. The invention improves the overall puzzle construction experience by eliminating the need to constantly pick up the puzzle box lid to reference the puzzle illustration during the construction process. Accordingly, the present disclosure makes specific reference to the construction and use of the invention, and several embodiments of the invention are disclosed herein. Nonetheless, the invention and its application should not be limited to the disclosed embodiments; rather the present invention is also applicable to other like applications, devices and methods of manufacture.

BACKGROUND OF THE INVENTION

By way of background, a large variety of games such as card games, board games, multi-player games, single-player games, arcade games, computer games and the like are available for the entertainment of children and adults. Puzzle games and other mind games are also popularly-known and played. These games develop valued attributes such as planning, critical thinking and strategic decision-making. Some puzzle games such as jigsaw puzzles are available to children of pre-school age, not only as a means of entertainment, but as a learning device. These games reinforce connections between brain cells, improve mental speed and are especially effective ways to improve short-term memory.

When a person does a jigsaw puzzle, the person needs to look at individual pieces of the puzzle (the game may include a plurality of pieces) and determine where the pieces fit into the bigger picture, which is illustrated on the puzzle box lid. More specifically, while putting together the pieces of the puzzle to form the bigger picture, the puzzler needs to reference the illustration on the puzzle box lid. This act of reference requires the person to hold the puzzle box lid in a manner such that the reference illustration can be easily viewed.

However, holding the puzzle box lid, while also attempting find the desired puzzle piece, can be both laborious and quite inconvenient. Adults and children may become easily frustrated while holding the lid and playing the game at the same time. Because it is difficult to hold the cover box lid while also looking for or placing puzzle pieces, the puzzler may have to do only one of these activities at a time, thereby increasing the time needed to complete the puzzle.

Therefore, there exists a long-felt need in the art for a puzzle box lid holder that allows the user to easily reference the puzzle illustration, while also looking for and arranging puzzle pieces. There also exists a long-felt need in the art for a puzzle box lid holder that eliminates the problems associated with having to continuously hold the puzzle box lid in a desired orientation, while also looking for or arranging the various puzzle pieces. A puzzle box holder device allows the illustration on the puzzle box lid to be visible to the puzzler at all times, while the puzzler looks for and arranges the puzzle pieces, improving the overall puzzle construction experience by eliminating the need to constantly pick up or hold the box lid. Finally, there is a long felt need in the art for a puzzle box lid holder that is relatively inexpensive to manufacture, and that is both safe and easy to use.

The subject matter disclosed and claimed herein, and described in one embodiment thereof, comprises a puzzle box lid holder that is designed to secure a puzzle box lid for hands-free viewing of the puzzle illustration on a box lid. The puzzle box lid holder comprises a solid wooden unit having an upper front surface, a lower front surface, a slot or recess slotted between the upper front surface and the lower front surface, a pair of generally parallel and spaced apart side surfaces each having a rectangular portion and a tapered portion, a top surface, a rear portion having a declined surface and a rectangular surface and a slot that is recessed in the solid wood. More specifically, the slot is sized and configured to receive a box lid wall from the front surface to secure the box lid in a substantially upright position. More specifically, the box lid wall is removably secured in the slot to allow a stable position of the box lid, such that a user can view the puzzle illustration on the box in a hands-free operation.

In this manner, the novel puzzle box lid holder of the present invention accomplishes all the forgoing objectives and provides an easy, convenient and efficient solution to hold the puzzle box lid and make the puzzle illustration visible at all the times while the puzzler constructs the puzzle. The puzzle box lid holder of the present invention is also user-friendly, as it is easy to insert the cover box lid wall into the box lid holder. The puzzle box lid holder enables the users to focus on the game by providing hands-free viewing of the puzzle illustration.

SUMMARY

The following presents a simplified summary to provide a basic understanding of some aspects of the disclosed innovation. This summary is not an extensive overview, and it is not intended to identify key/critical elements or to limit the scope thereof. Its sole purpose is to present some general concepts in a simplified form as a prelude to the more detailed description that is presented later.

The subject matter disclosed and claimed herein, in one embodiment thereof, comprises a puzzle box lid holder designed to secure a puzzle box lid for hands-free viewing of a puzzle illustration on the box lid. The holder is comprised of a solid unit made of wood, metal, plastic, ceramic or other suitable material, having an upper front surface, a lower front surface, a slot or recess slotted between the upper front surface and the lower front surface, a pair of side surfaces each having a rectangular portion and a tapered portion, a top surface, a rear portion having a declined surface and a rectangular surface, and a slot recessed in the solid wood of the rectangular side portion and is configured to receive a box lid wall from the front surface to secure the box lid in a substantially upright position. The box lid wall is secured in the slot to allow a stable position of the box lid such that a user can view the puzzle illustration on the box in a hands-free operation.

In a second embodiment of the present invention, a portable puzzle box lid holder device is disclosed and is comprised of a slot in the holder body, which may be of any shape, such as rectangular, spheroidal or cylindrical, to secure a wall extending from a lid of a puzzle box to hold the puzzle box lid in a substantially upright position, allowing a user hands-free viewing of the puzzle illustration on the puzzle box lid. The puzzle box lid holder device improves the overall puzzle construction experience of the user by eliminating the need to pick up the box lid to reference the puzzle illustration. The slot is present across the front portion of the holder device.

In a third embodiment of the present invention, a method of manufacturing a portable puzzle box lid holder to hold a puzzle box lid in a substantially upright position is disclosed and is comprised of taking a block of solid material and using a table saw or any other recessing tool to form a slot or opening therein, wherein the slot is dimensioned to secure a metal or cardboard lid such as a puzzle box lid. A recessing tool is used to make a cut from the top surface to the rear surface of the block, thereby resulting in each of the opposing side surfaces having a generally rectangular portion and a tapered portion, and the rear portion having a declined surface and a rectangular surface.

The box lid remains secure and does not tilt in the slot. The slot is in the form of a recess and firmly holds the box lid. The dimensioning of the slot or recess is such that it prevents slipping of the box lid, regardless of the size of the box lid. In a preferred embodiment, the slot has a depth of up to approximately 3" within the body of the holder device and a thickness of approximately 0.2", thereby allowing it to hold and secure any metal or cardboard-based lid firmly. Additionally, the puzzle box lid holder may further comprise openings or holes in its upper surface, or other surfaces, to allow the box lid holder to hold pencils, pens or paint brushes, etc., thereby allowing the box lid holder to also be used as a pen, pencil or other object holder when not being used as a box lid holder.

The puzzle box lid holder may also hold items other than a box lid. The holder may be used to hold name plates that are framed in a T shaped bracket such that the bracket can be inserted into the slot of the holder in a similar way that the box lid wall is inserted into the holder. Similar brackets might be made to hold books or music, allowing the puzzle box lid holder to also function as a book or music holder.

The puzzle box lid holder may have a protective membrane or coating that is preferably waterproof to protect the holder. The protective membrane or coating may be made of a wax, a relatively thin plastic, or some other generally impermeable material that resists moisture and provides an attractive appearance to the puzzle box lid holder. The advantage of the puzzle box lid holder of the present invention is that it provides a hands-free viewing of the puzzle illustration on the box lid cover. The holder device improves the overall puzzle construction experience by eliminating the need to constantly pick up the box lid for reference.

Aspects of the disclosed innovation are described herein in connection with the following description and the annexed drawings. These aspects are indicative, however, of but a few of the various ways in which the principles disclosed herein can be employed, and are not intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views in which.

DETAILED DESCRIPTION

Figure 1:
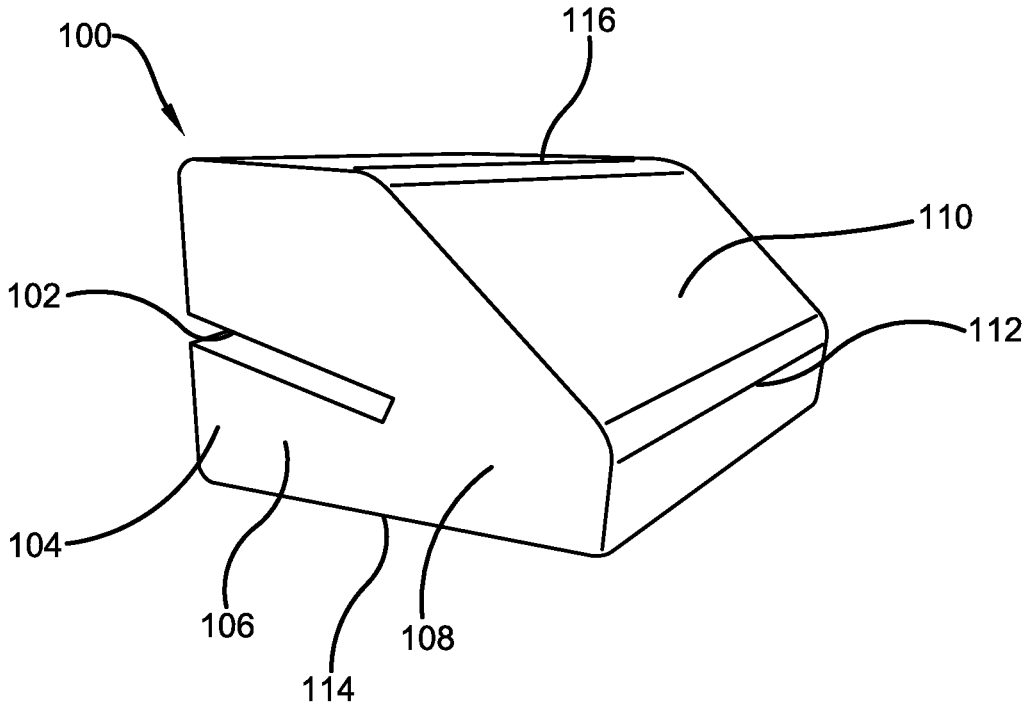
FIG. 1 illustrates a side perspective view of one potential embodiment of the puzzle box lid holder of the present invention in accordance with the disclosed description.

The innovation is now described with reference to the drawings, wherein like reference numerals are used to refer to like elements throughout. In the following description, for purposes of explanation, numerous specific details are set forth to provide a thorough understanding of the invention. It may be evident, however, that the innovation can be practiced without these specific details. In other instances, well-known structures and devices are shown in block diagram form to facilitate a description thereof. Various embodiments are discussed, and it should be noted that the figures are described only to facilitate the description of the embodiments. The described embodiments are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a device which allows the users to easily complete a puzzle and enjoy the game. There is also a long-felt need in the art for a device which eliminates the need to continuously hold the puzzle box lid while arranging the puzzle pieces together, to form the puzzle based on the reference picture on the puzzle box lid. Additionally, there is a long-felt need in the art for a holding device which securely holds the puzzle box lid and allows the person to completely focus on the game. Moreover, there is a long-felt need in the art for a puzzle box lid holder which prevents the users from constantly grabbing and holding up the box while attempting to complete the puzzle. Further, there is a long-felt need in the art for a puzzle box lid holder device which allows the illustration on the puzzle box lid to always be visible while arranging the puzzle pieces. Finally, there is a long-felt need in the art for a puzzle box lid holder device which improves the overall puzzle construction experience by eliminating the need to hold or pick up the box lid to reference the puzzle illustration.

The present invention, in one exemplary embodiment, is a novel puzzle box lid holder designed to secure a puzzle box lid for hands-free viewing of a puzzle illustration on the box lid, comprising a solid wooden unit having an upper front surface, a lower front surface, a slot or recess slotted between the upper front surface and the lower front surface, a pair of side surfaces each having a rectangular portion and a tapered portion, a top surface, a rear portion having a declined surface and a rectangular surface and a slot recessed in the solid wood that is configured to receive a box lid wall from the front surface to secure the box lid in a substantially upright position. The box lid wall is secured in the slot to allow a stable position of the box lid, such that a user can view the puzzle illustration on the box in a hands-free operation.

Referring initially to the drawings, FIG. 1 illustrates a side perspective view of a puzzle box lid holder of the present invention as per the disclosed design. The puzzle box lid holder 100 of the present invention is a decorative and durable holder device for a puzzle box lid. The lid may be constructed of cardboard, plastic or metal. A puzzle box lid is generally used as a guide to complete puzzles, has a picture on the lid as a reference. The puzzle box lid holder 100 is a single unit, lightweight and decorative product, made up of wood, plastic, ceramic or metal. The holder 100 has a slot 102 slotted through the front surface and partially through the side surfaces to secure a box lid in an upright position. The holder 100 has a pair of opposite side surfaces, wherein each side surface has a rectangular portion and a tapered portion. As shown, a first side surface 104 has a rectangular portion 106 and a tapered portion 108 divided by a virtual partition 114. The slot 102 extends through the rectangular portion 106 up to the virtual partition 114.

The rear portion of the puzzle box lid holder 100 has a declined portion 110 and a straight portion 112. The rear portion gives an aesthetic appeal to the box holder 100. The box holder 100 is a solid piece of wood or metal having the slot 102 slotted in a non-horizontal direction to give more stability to the secured box lid. The declined portion 110 has about a forty-five degree decline angle from the top surface 116 of the box holder 100.

The box holder 100 has a smooth finish with no sharp edges, and may be made up of sturdy wood such as red cedar, black walnut, etc. The box holder may also be made of plastic, ceramic or metal, or any combination thereof. The box holder 100 may come in various dimensions and colors to secure a box lid of various sizes and thickness, and provide aesthetic appeal.

Figure 2:
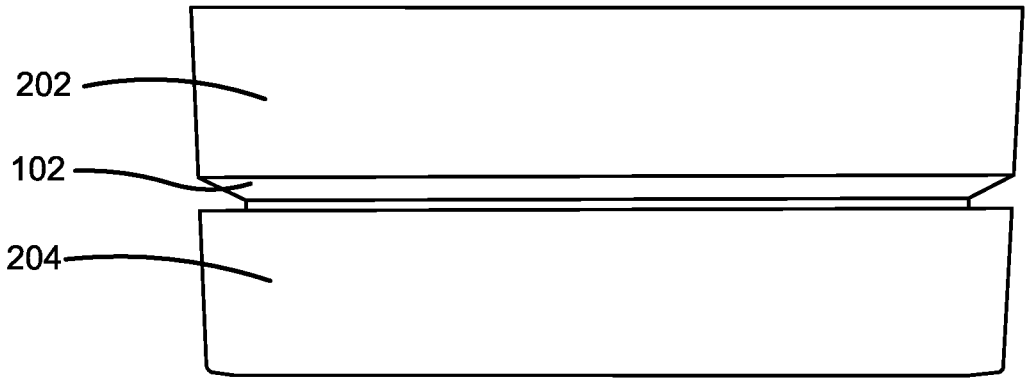
FIG. 2 illustrates a front perspective view of one potential embodiment of the puzzle box lid holder of the present invention in accordance with the disclosed description.

FIG. 2 illustrates a front perspective view of the puzzle box lid holder of the present invention as per the disclosed design. The puzzle box lid holder 100 has an upper rectangular front portion 202 and a lower rectangular front portion 204, with the slot 102 slotted between the upper rectangular front portion 202 and the lower rectangular front portion 204, to secure and hold a puzzle box lid. The slot 102 may have a thickness of approximately 0.2", for example to secure a conventional cardboard or metal box lid. The upper rectangular front portion 202 and the lower rectangular front portion 204 have similar thicknesses, and are strong enough to support the secured puzzle box lid.

The slot 102 is preferably slotted deep into the box holder 100 and may have depth of up to 3" to provide stability to the puzzle box lid. The slot 102 may be slotted using a chisel or a table saw, for example. The thickness of each front rectangular portion 202, 204 may be up to approximately 2".

Figure 3:
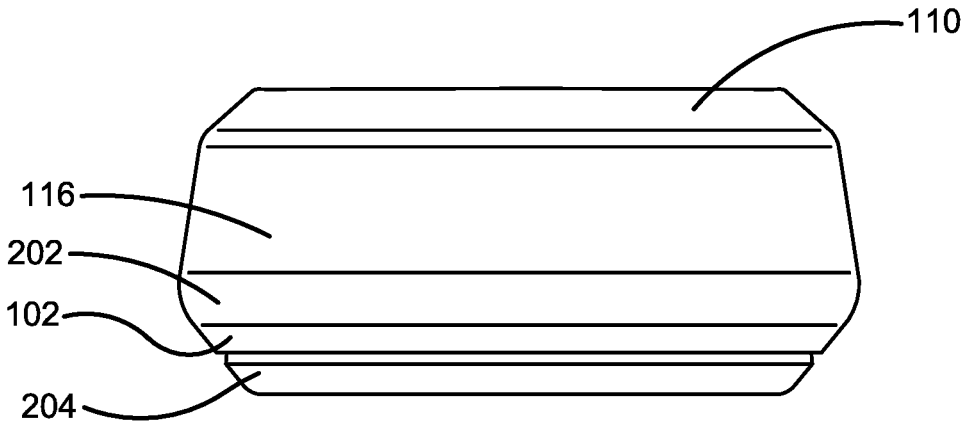
FIG. 3 illustrates a top perspective view of one potential embodiment of the puzzle box lid holder of the present invention in accordance with the disclosed description.

FIG. 3 illustrates a top perspective view of the puzzle box lid holder of the present invention as per the disclosed design. The lid holder 100 has a rectangular top surface 116 and a rear declined surface 110 which continues from the top surface 116. The slot 102 is slotted or carved out at the vertical midpoint of the front portion, with the equal upper rectangular front portion 202 and the lower rectangular front portion 204 forming the front portion. In one embodiment, the dimensions of the box holder 100 are 4" (H)×5" (W)×3" (D). Alternatively, the dimensions of the box holder 100 are 3.5" (H)×4.5" (W)×3" (D).

Figure 4:
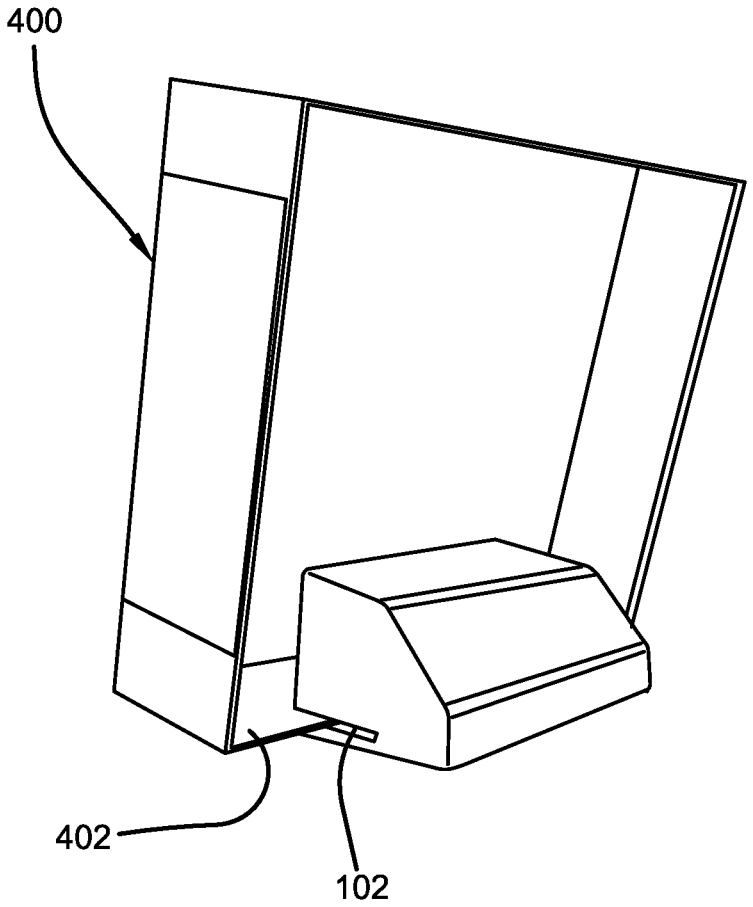
FIG. 4 illustrates a perspective view of one potential embodiment of the puzzle box lid holder of the present invention holding a puzzle box lid in an upright position in accordance with the disclosed description.

FIG. 4 illustrates a perspective view of the puzzle box lid holder of the present invention, holding a puzzle box lid in an upright position as per the disclosed design. The slot 102 slotted through the holder 100 receives a box lid wall 402, and is secured in an upright manner such that the box lid 400 remains accessible in a hands-free operation. The picture on the box lid 400, used as a puzzle constructor, is easily viewed by a user when the box lid 400 is secured by placing the box lid wall 402 into the slot 102. Stated differently, the user maintains hands-free viewing of the illustration on the box lid 400 as the user completes the puzzle. The slot 102 has a thickness to accommodate the box lid 400 of conventional thickness. In the preferred embodiment, the slot 102 is slotted in an angular manner and is not absolutely horizontal, such that the box lid 400 is secured in a position such that the puzzle picture can be easily viewed by a user from a slightly upper angle.

The box lid 400 is secured and kept at a convenient height for a user to view the puzzle picture. The box holder 100 may be kept on any surface such as on a floor or a table. The angle at which the box lid 400 is positioned and provides a comfortable viewing for the user. The slot 102 of the puzzle box lid holder 100 may hold any puzzle top box, or even posters.

The box holder 100 may be made of hardwood and may be hand-crafted or machine-crafted. The box holder 100 provides great stability, while having a small footprint. The box holder 100 may come with a carrying pouch or box for easy portability. The holder 100 requires no assembling or disassembling and is a single unit product, which may come in various dimensions to secure puzzle boxes of different sizes.

In one embodiment, the box holder 100 may have a customized name or logo 120 engraved on any of its surfaces and may be used for gifting purposes. The box holder 100 has a solid base, and does not shift or fall even while holding heavy puzzle boxes. The box holder 100 has low cost of manufacture with regard to materials and labor, allowing for a low sales price, thereby making such puzzle box lid holders economically available to the buying public.

Figure 5:
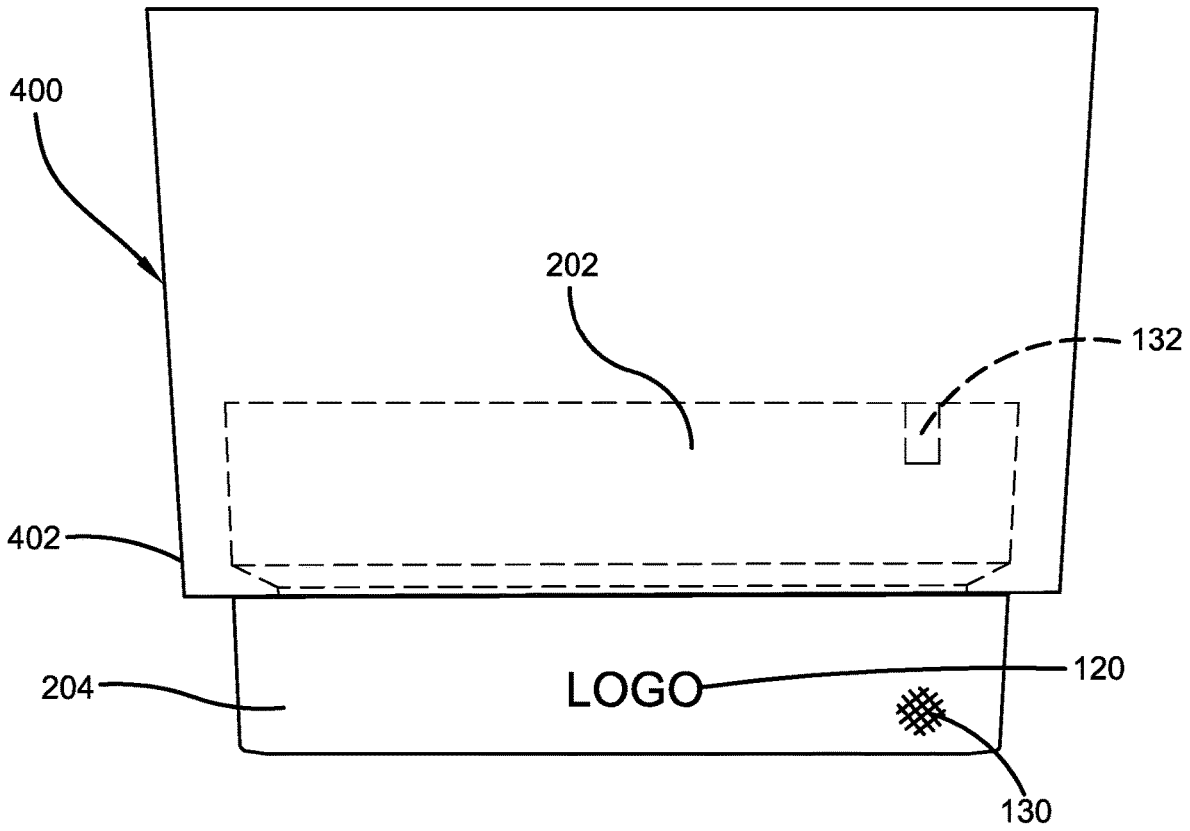
FIG. 5 illustrates a front perspective view of one potential embodiment of the puzzle box lid holder of the present invention holding a puzzle box lid in accordance with the disclosed description.

FIG. 5 illustrates a front perspective view of the puzzle box lid holder of the present invention holding a puzzle box lid as per the disclosed design. More specifically, a wall 402 of the box lid 400 is inserted into the slot 102, present between the upper rectangular front portion 202 and the lower rectangular front portion 204. In the preferred embodiment, the slot 102 is slotted in an angular manner (preferably between 0 and 45 degrees relative to the bottom surface, and more preferably between 15 and 35 degrees), and is not horizontal, such that box lid 400 is secured in a position such that the puzzle picture can be easily viewed from a slightly upper angle and position. The viewing angle of the box lid 400 is ideal for a user, who can enjoy the puzzle without worrying about handling of the puzzle picture. The slot 102 has a depth such that a lid wall can be inserted completely into the slot 102 for stable and secure positioning of the lid 400. The box holder 100 has rounded edges and corners, and is lightweight and portable.

As stated above, the puzzle box lid holder 100 may have a protective membrane or coating 130 that is preferably waterproof to protect the holder 100. The protective membrane or coating 130 may be made of a wax, a relatively thin plastic, or some other generally impermeable material that resists moisture and provides an attractive appearance to the puzzle box lid holder 100. In a further preferred embodiment, the coating 130 may further comprise an anti-microbial agent such as, but not limited to, MicroBan® to prevent the transmission of germs, bacteria, pathogens and the like if, for example, multiple puzzlers will all be working on the same puzzle and touching or otherwise handling the holder 100.

Additionally, the puzzle box lid holder 100 may further comprise openings or holes 132 in its upper surface, or other surfaces, to allow the box lid holder 100 to hold pencils, pens or paint brushes, etc., thereby allowing the box lid holder 100 to also be used as a pen, pencil or other object holder when not being used as a box lid holder.

In one embodiment of the present invention, a method of manufacturing a portable puzzle box lid holder to hold a puzzle box lid in a substantially upright position is disclosed and comprises taking a block of solid wood and making a slot using a table saw or any other wood recessing tool wherein the slot is dimensioned to secure a metal or cardboard lid, dimensioning the side surfaces having a rectangular portion and a tapered portion, and dimensioning the rear portion having a declined surface and a rectangular surface.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "puzzle box lid holder", "puzzle box lid holder", "lid holder", and "box holder", are interchangeable and refer to the puzzle box lid holder 100 of the present invention.

Notwithstanding the forgoing, the puzzle box lid holder 100 and its components of the present invention can be of any suitable size and configuration as is known in the art without affecting the overall concept of the invention, provided it accomplishes the above-stated objectives. One of ordinary skill in the art will appreciate the sizes, configurations, and materials of the puzzle box lid holder 100 shown in the FIGS. are for illustrative purposes only, and that many other sizes, configurations and materials of the puzzle box lid holder 100 are well within the scope of the present disclosure. Although the dimensions of the puzzle box lid holder 100 are important design parameters for user convenience, the puzzle box lid holder 100 may be of any size that ensures optimal performance during use and/or that suits the user's needs and/or preferences.

Various modifications and additions can be made to the exemplary embodiments discussed without departing from the scope of the present invention. While the embodiments described above refer to specific features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive, similar to the term "comprising" as "comprising" is interpreted when employed as a transitional word in a claim.

What is claimed is:

1. A puzzle box lid holder comprising:
a top surface that comprises at least one opening;
a bottom surface;
a pair of opposing side surfaces;
a rear surface comprised of an upper portion and a lower portion, wherein the upper portion is angled relative to the lower portion, and further wherein the angle is between 15 and 35 degrees; and
a front surface having a slot therein, wherein the slot is positioned at an angle relative to the bottom surface and extends up to three inches across a width of each of the pair of opposing side surfaces.

2. A puzzle box lid and holder combination comprising:
a puzzle box lid; and
a puzzle box lid holder comprising:
a bottom surface;
a front surface;
a pair of side surfaces;
a top surface;
a rear surface;
a slot in the front surface that divides the front surface into an upper front surface and a lower front surface, wherein the slot is either substantially parallel to, or at an angle with, the bottom surface, and further wherein the puzzle box lid is positioned in the slot.

3. The puzzle box lid and holder combination of claim 2, wherein the angle is between 0 and 45 degrees.

4. The puzzle box lid and holder combination of claim 3, wherein the angle is between 15 and 35 degrees.

5. The puzzle box lid and holder combination of claim 4, wherein the slot extends across an entire width of the front surface.

6. The puzzle box lid and holder combination of claim 5, wherein the slot extends up to three inches across a width of each of the pair of side surfaces.

7. The puzzle box lid and holder combination of claim 5, wherein the top surface further comprises at least one opening and the puzzle box lid holder comprises at least one protective coating from a group consisting of a waterproof coating and an anti-microbial coating.

* * * * *